US006540568B2

(12) United States Patent
Miyazaki

(10) Patent No.: US 6,540,568 B2
(45) Date of Patent: Apr. 1, 2003

(54) SHIELD CONNECTOR

(75) Inventor: Sho Miyazaki, Nagoya (JP)

(73) Assignees: Autonetworks Technologies, Ltd., Nagoya (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/043,183

(22) Filed: Jan. 14, 2002

(65) Prior Publication Data

US 2002/0098744 A1 Jul. 25, 2002

(30) Foreign Application Priority Data

Jan. 24, 2001 (JP) ..... 2001-016229

(51) Int. Cl.[7] ..... H01R 13/11

(52) U.S. Cl. ..... 439/851; 439/843; 439/607; 439/852

(58) Field of Search ..... 439/851, 852, 439/607, 608, 609, 610, 842, 843, 856, 857

(56) References Cited

U.S. PATENT DOCUMENTS 5,088,942 A * 2/1992 Welsh et al. ..... 439/843
5,108,318 A * 4/1992 Sakurai et al. ..... 439/744
5,203,813 A * 4/1993 Fizimmons ..... 29/876
5,730,628 A * 3/1998 Hawkins ..... 439/843
6,102,746 A * 8/2000 Nania et al. ..... 439/675
6,129,585 A * 10/2000 Hashizava ..... 439/607
6,254,439 B1 * 7/2001 Endo et al. ..... 439/843
6,482,049 B1 * 11/2002 Swearingen ..... 439/843

FOREIGN PATENT DOCUMENTS

EP 1 079 475 A2 2/2001

* cited by examiner

*Primary Examiner*—P. Austin Bradley
*Assistant Examiner*—Alexander Gilman
(74) *Attorney, Agent, or Firm*—Oliff & Berridge, PLC

(57) ABSTRACT

Upon coupling a shield connector 10 to a partner-side connector 50, the cam followers 37 of the shield connector 10 are made engage with the cam grooves of a lever 56 provided at the partner-side connector 50, and the lever 56 is rotated. Then, the shield shell 55 covering the outer surface of the tip end side of the terminal housing tube 52 moves into the fit-in portions 15 of an inner housing 12, so that the belt portions 19B of belt-shaped elastic pieces 19 are applied with a force directed to the inner side of an inner housing fit-in hole 34 due to the sliding-contact resistance between the belt-shaped elastic pieces and the shield shell 55. However, according to the embodiment, the sliding-contact resistance acts as a force of pulling the belt-shaped elastic pieces 19.

4 Claims, 7 Drawing Sheets

SHIELD CONNECTOR

BACKGROUND OF THE INVENTION

1. Technical Field

The present invention relates to a shield connector.

2. Related Art

FIG. 7(A) shows a conventional shield connector which is configured in a manner that a connector housing 1 with electric conductivity (made of aluminum, for example) is provided with a fitting hole 3 in which the shield shell 2 of a partner-side connector is inserted. A shield contact 4 is inserted from the rear end opening 3A of the fitting hole 3 on the opposite side of the partner-side connector, and the rear end opening 3A is blocked or closed by an inner housing 5. Then, the shield contact 4 is held within the fitting hole 3 between the inner hosing 5 and a come-out prevention projection 7 provided on the front side with respect to the shield contact 4 in the fitting hole 3.

Problems to be Solved

However, according to the shield connector configured in the aforesaid manner, when the shield shell 2 is inserted within the fitting hole 3, each of the elastic belt portions 4A of the shield contact 4 is compressed in the axial direction due to the sliding-contact resistance between the partner-side shield shell 2 and the elastic belt portion and deforms so as to shrink toward the inside. As a result, each of the elastic belt portions 4A is strongly pressed against the partner-side shield shell 2 thereby to further increase the sliding-contact resistance. Thus, the entire fitting resistance of the connector becomes large.

Further, as shown in FIG. 7(B), the shield contact 4 is configured in a manner that a plurality of elastic belt portions 22 couple between a pair of ring portions 21, 21 aligned coaxially and the center potion of each of the elastic belt portions 22 is bent toward the inside. Since the shield contact configured in this manner is formed by punching a metal plate as base material, for example, the yield of the material is bad and so the manufacturing cost is high.

SUMMARY OF THE INVENTION

The invention has been made in view of the aforesaid circumstances and an object of the invention is to provide a shield connector which can make a fitting resistance between a partner-side connector and the shield connector small.

Means for Solving the Problems

In order to attain the aforesaid object, the shield connector according to the invention as in aspect 1 is arranged in a manner that in a shield connector which is configured in a manner that an insulative inner housing holding a terminal metal member to be coupled with a terminal metal member of a partner-side connector is accommodated within an external housing with electric conductivity, and when the partner-side connector is fitted into the shield connector, the terminal metal members of the shield connector and the partner-side connector are coupled to each other and a shield shell of the partner-side connector is coupled with the external housing, the shield connector is characterized in that the inner housing includes a holding portion which extends toward an opening end side of the external housing and is positioned outside of the shield shell of the partner-side connector fitted into the shield connector, and further includes a shell coupling metal member which contacts with the shield shell at an inside of the holding portion and contacts with the external housing at an outside of the holding portion, and wherein the shell coupling metal member is engaged at its front end with the holding portion.

The invention according to aspect 2 is arranged, in the arrangement of aspect 1, in a manner that the holding portion is formed to have a cylindrical shape in which the shield shell is inserted, the shell coupling metal member is configured by a plurality of belt-shaped elastic pieces with same shape, and the holding portion is provided with slits for passing the belt-shaped elastic pieces from an inside of the holding portion to an outside thereof.

Function and Effects of the Invention (The Invention of Aspect 1)

According to the configuration of aspect 1, when the partner-side shield connector is inserted within the shield connector, the shell coupling metal member provided at the holding portion of the inner housing is applied with a force toward the inner side of the external housing due to the sliding-contact resistance between the shell coupling metal member and the shield shell. In this respect, according to the invention, since the shell coupling metal member is engaged at its front end with the holding portion, the sliding-contact resistance acts as a force of pulling the shell coupling metal member. Thus, according to the invention, unlike the conventional technique, the shell coupling metal member is prevented from being compressed and extending inside, so that the fitting operation of the connectors can be performed smoothly.

(The Invention of Aspect 2)

According to the configuration of aspect 2, since the shell coupling metal member is configured by a plurality of belt-shaped elastic pieces with same shape, each of the belt-shaped elastic pieces can be formed easily from a metal plate of almost rectangular shape, so that the shell coupling metal member of the invention is quite good in yield of material as compared with the conventional shell coupling metal member. Further, since the conventional shell coupling metal member is formed integrally, plural types of the shell coupling metal members are required to be formed in accordance with the outer diameters of the shield shells that are inserted into the shell coupling metal members. In contrast, according to the shell coupling metal member of the invention, when the shell coupling metal member is configured so as to be formed by a plurality of the belt-shaped elastic pieces and engaged with the holding portions of the inner housing, a hole in which the shield shell is inserted can be formed. Thus, the shell coupling metal member can be commonly used among various kinds of shield connectors in which shield shells with different outer shapes are inserted.

Further, for example, when the partner-side connector is inserted diagonally with respect to the external housing, the belt-shaped elastic pieces may be pressed with an excessive force against the inner side surface of the holding portion of the inner housing by the tip end portion of the shield shell. In this respect, according to the invention, the holding portion is provided with slits for passing the belt-shaped elastic pieces from the inside to the outside of the holding portion. Thus, the belt-shaped elastic pieces are prevented from being scooped by the inner side surface of the holding portion and being bent excessively, and so the elastic configuration of each of the belt-shaped elastic pieces can be protected.

DETAILED DESCRIPTION OF THE PREFERRED EMBODIMENTS

Mode for Carrying Out the Invention

The embodiment of the invention will be explained based on FIGS. 1 to 6. The shield connector 10 according to the embodiment is configured to accommodate an inner housing 12 made of insulative resin within an external housing 11 made of electrically conductive resin.

Figure 1:
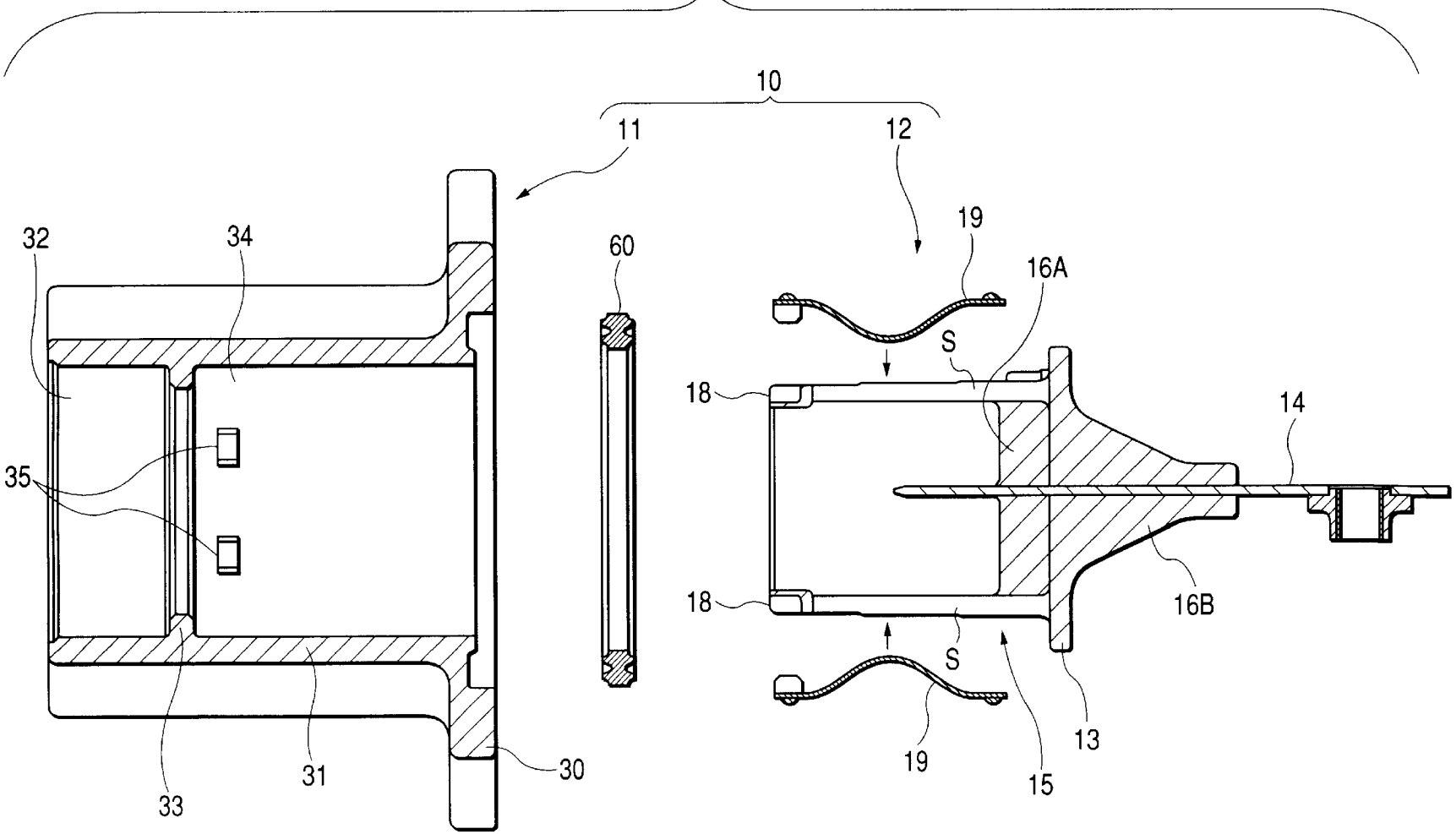
FIG. 1 is an exploded sectional view of a shield connector according to the first embodiment of the invention.
Figure 2:
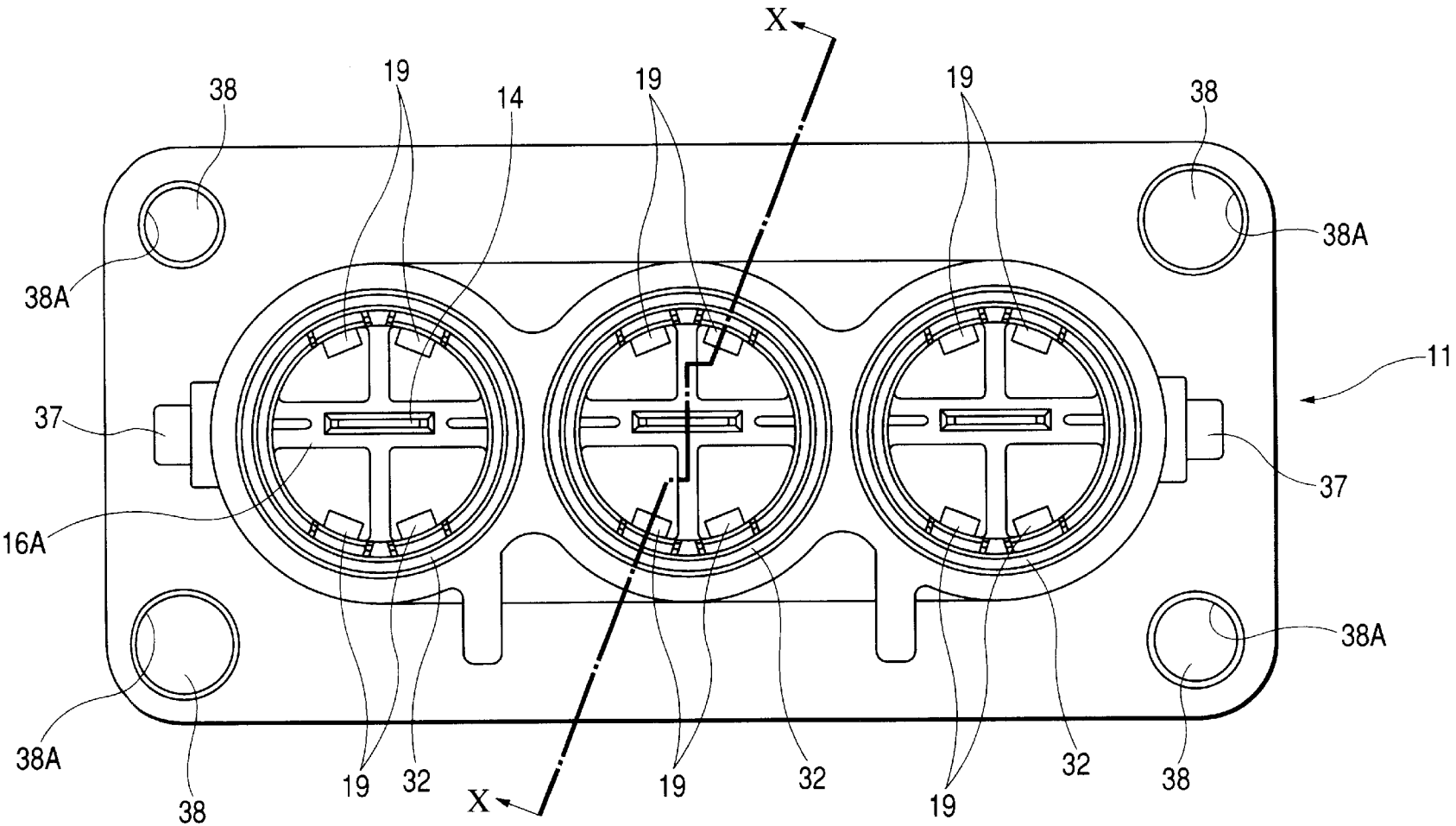
FIG. 2 is a front view of the shield connector.
Figure 3:
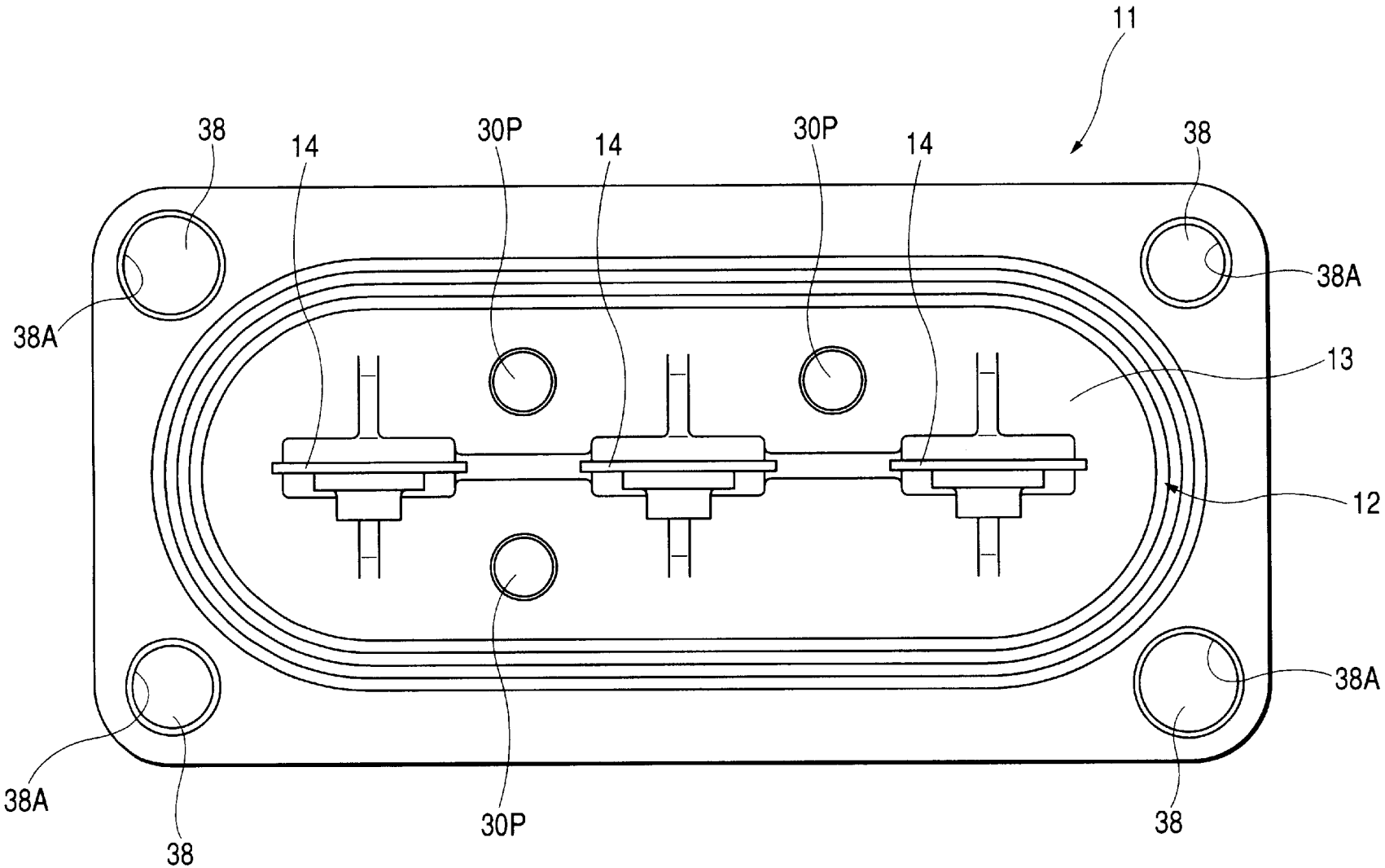
FIG. 3 is a rear view of the shield connector.

The external housing 11 is formed by the electrically conductive resin as described above and the electrically conductive resin is formed by mixing electrically conductive filling material such as carbon etc. with composite resin. As shown in FIG. 1, the external housing 11 is configured to have a flat plate portion 30 with almost rectangular shape and a terminal housing portion 31 protruding forwardly (the left side in FIG. 1) from the flat plate portion 30. As shown in FIG. 2, within the terminal housing portion 31, three terminal housing chambers 32 each having a circular shape in section are disposed so as to be aligned along the longitudinal width direction and to penetrate the terminal housing portion. Further, as shown in FIG. 3, a plurality of press-in pins 30P are formed on the rear surface of the flat plate portion 30 so as to protrude backward from plural portions positioned at the periphery of the centered one of the terminal housing chambers 32. These press-in pins 30P are pressed into not-shown press-in holes formed at the inner housing 12 described later.

As shown in FIG. 1, projections 33 are formed at portions near the front side of each of the terminal housing chambers 32 along longitudinal direction thereof and also along the inner peripheral surface thereof. The inner side (the right side in FIG. 1) from the projections 33 of the terminal housing chambers 32 forms an inner housing fit-in hole 34 in which the fit-in portions 15 (corresponding to "holding portions" of the invention) of the inner housing 12 described later are fitted and attached thereto.

Incidentally, as shown in FIG. 2, attachment holes 38 are formed at four corner portions of the flat plate portion 30 of the external housing 11 so as to penetrate therethrough, and metal rings 38A are pressed into the attachment holes 38, respectively. Cam followers 37, 37 are formed on the outer surface of the terminal housing portion 31 of the external housing 11 so as to protrude toward both sides thereof.

As shown in FIG. 3, the inner housing 12 is provided with three male tabs 14 at three portions of the transversely-extended flat plate portion 13 along the longitudinal direction thereof, respectively. Further, as shown in FIG. 1, the three cylindrical fit-in portions 15 (only one of the fit-in portions 15 is shown in FIG. 1) are formed at the front surface (the left side surface in FIG. 1) of the flat plate portion 13 in correspondence with the male tabs 14, respectively. The male tabs 14 penetrate a reinforcement wall 16A formed on the inner side of the fit-in portions 15. A reinforcement wall 16B is also formed at the portion of the rear surface of the inner housing 12 where the male tabs 14 penetrate. Further, as shown in FIG. 3, a plurality of press-in holes are formed at predetermined positions of the flat plate portion 13 so as to penetrate therethrough.

Figure 4:
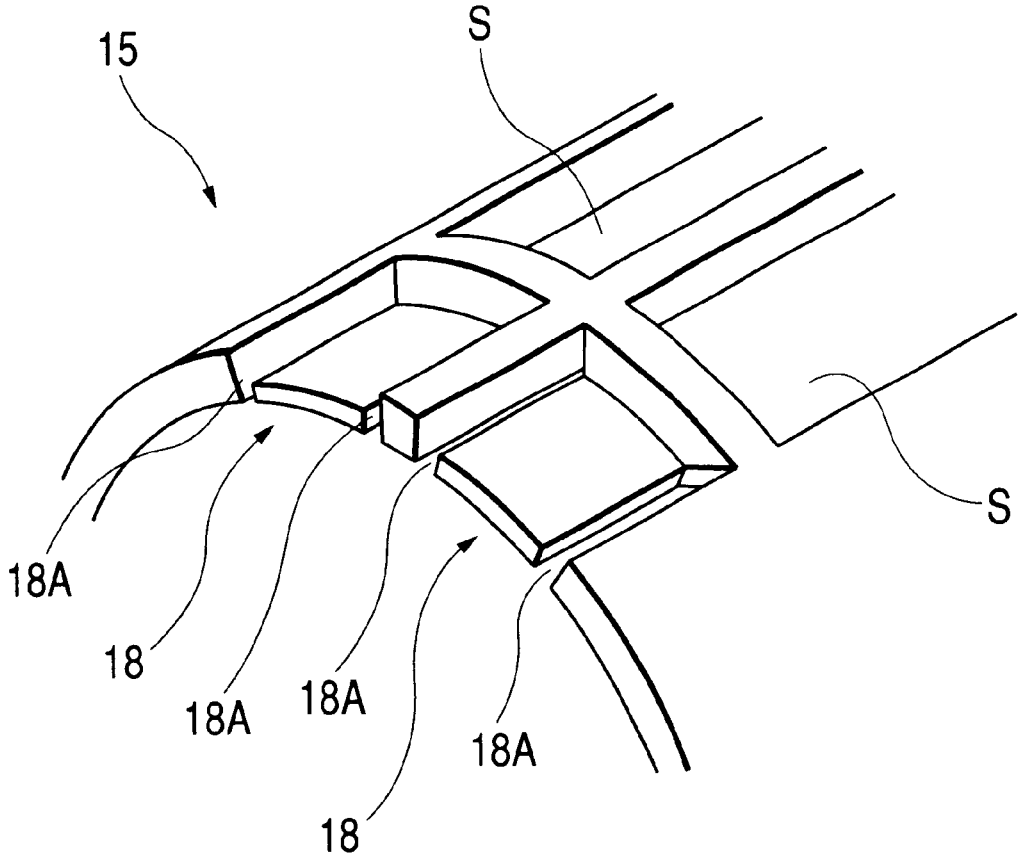
FIG. 4 is an enlarged view of an engagement portion.

As shown in FIG. 1, a pair of engagement portions 18 for engaging a belt-shaped elastic piece 19 described later are formed at each of the upper side (a portion on the upper side in the figure) and the lower side of the front end (the left side in the figure) of the fit-in portions 15 (only the upper and lower fit-in portions 15 are shown in FIG. 1), respectively. Further, slit portions S extending in the longitudinal direction are formed from the rear side of the fit-in portion to the flat plate portion 13 in corresponding to the engagement portions 18, respectively. To be more concrete, as shown in FIG. 4, each of the engagement portions 18 is provided with a pair of notched portions 18A at the front end side of the fit-in portion 15 so as to extend in the longitudinal direction thereof. The portion of each of the engagement portions surrounded by the notched portions 18A is configured to have a surface stepped down on the outer peripheral surface side thereof. The pair of the notched portions 18A have widths corresponding to a pair of the hook portions 19A of the belt-shaped elastic piece 19 described later, respectively. Each of the slit portions S is formed to have a width slightly larger than that of the belt-shaped elastic piece 19.

Figure 5A:
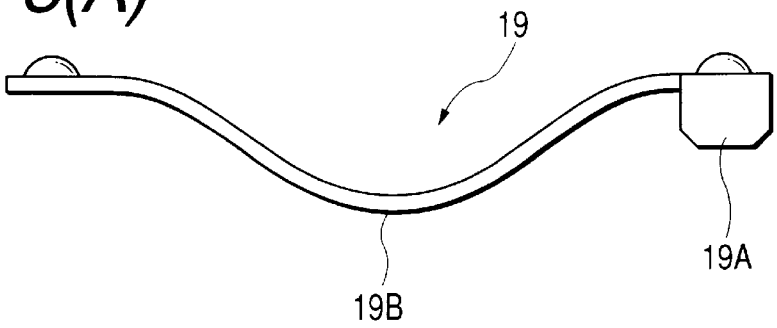
FIG. 5 is a front and plan views of a belt-shaped elastic piece.
Figure 5B:
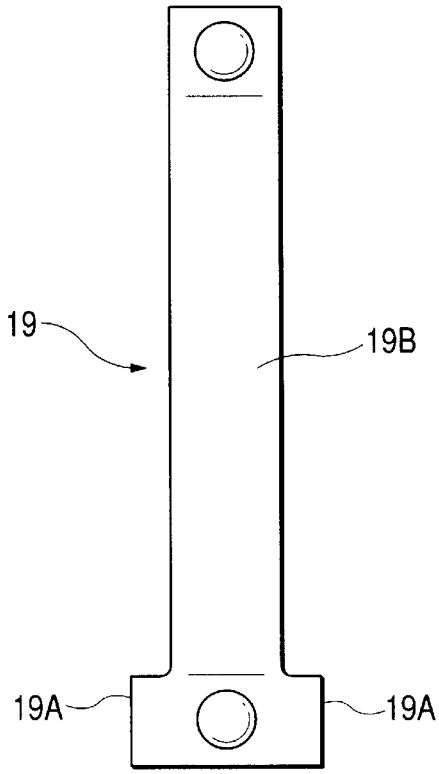
Figure 5C:
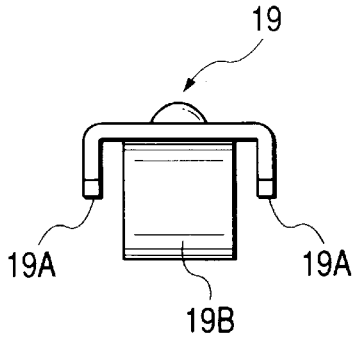

As shown in FIG. 5, each of the belt-shaped elastic pieces 19 is made of metal and formed in almost belt shape and configured in a manner that the pair of hook portions 19A to be attached to the engagement portion 18 are formed at the one end thereof. Such a belt-shaped elastic piece is formed in a manner that, of a T-shaped metal plate as base material, the both ends of a portion corresponding to a shorter side of the T-shape are bent in the same direction to form the pair of the hook portions 19A, and a portion corresponding to a longer side of the T-shape (hereinafter called "a belt portion 19B") is bent on the way thereof in the same direction as the projecting direction of the hook portions 19A.

The shield connector 10 is assembled in the following manner. To this end, first, the belt-shaped elastic pieces 19 are attached to the fit-in portion 15 of the inner housing 12 from the side direction thereof. To be more concrete, the hook portions 19A of the belt-shaped elastic piece are hooked on the notched portions 18A of the engagement portion 18 while inserting the belt portion 19B into the slit portions S of the fit-in portion 15. Thereafter, the rubber ring 60 is attached to the recess portion of the flat plate portion 30 of the external housing 11, then the fit-in portions 15 of the inner housing 12 are inserted within the terminal housing chambers 32 of the external housing 11, respectively, and the inner housing and the external housing are pushed to each other in a manner that the flat plate portions 30, 13 are overlapped to each other. Thus, the press-in pins 30P formed at the flat plate portions 30, 13 are pressed into the press-in holes thereby to hold the external housing 11 and the inner housing 12 integrally. In this case, the hook portions 19A of the belt-shaped elastic piece 19 abut at their upper side surfaces against the terminal housing chamber 32 and are sandwiched between the projection 33 at the forward side and the notched portions 18A of the engagement portion 18 at the backward side thereby to be held so as not to be able to move axially. Accordingly, the belt-shaped elastic piece 19 is engaged at its front end against the fit-in portion 15 and further conductively coupled with the external housing 11.

The shield connector 10 is covered by a connector attachment hole formed at a not-shown panel and screwed on the panel by means of bolts passed through the attachment holes 38 of the flat plate portion 30. Thus, the rubber ring 60 is crushed between the panel and the flat plate portion 30 thereby to realize the water-proof function and conductively couple the external housing 11 and the panel.

Figure 6:
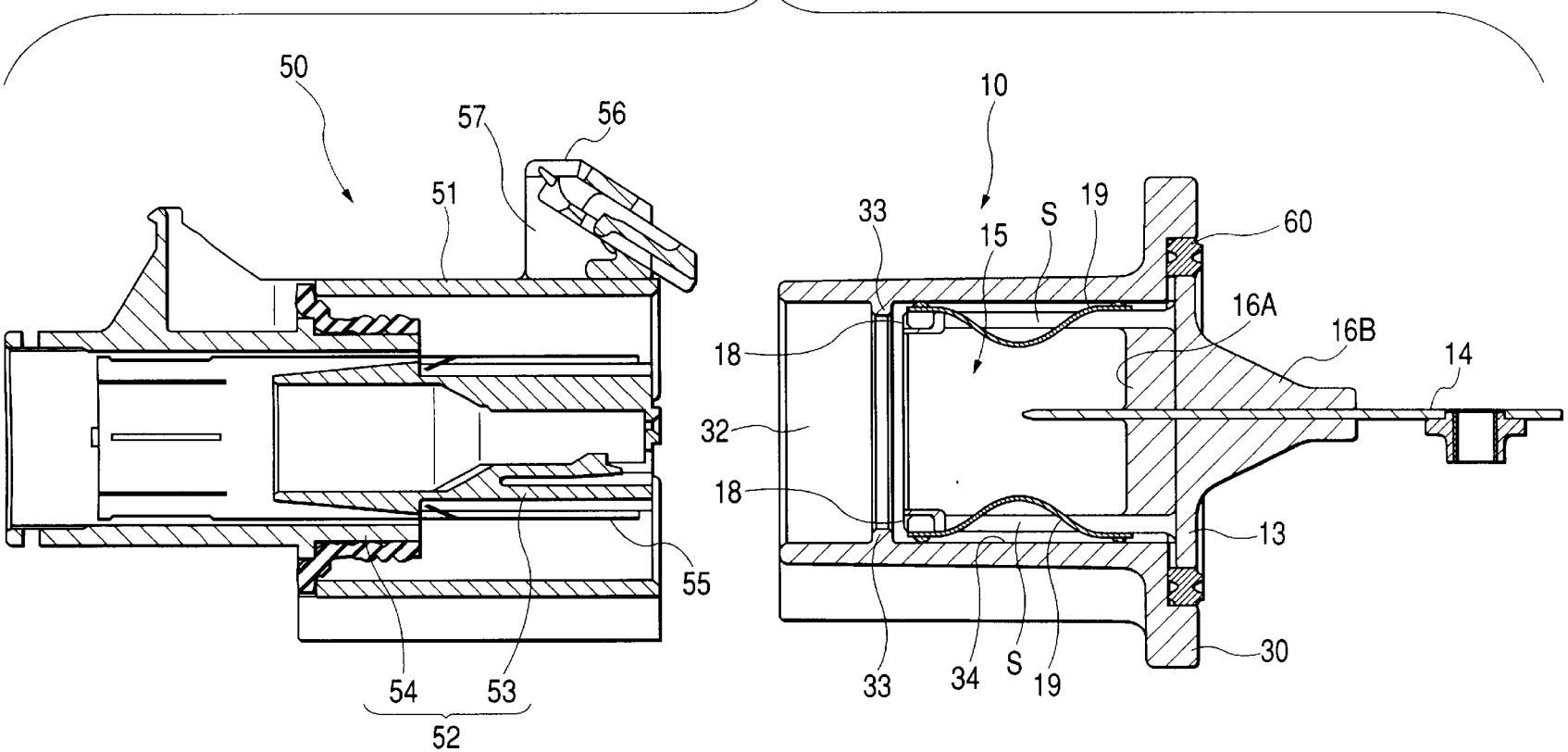
FIG. 6 is a sectional side view of female and mail connectors.
Figure 7A:
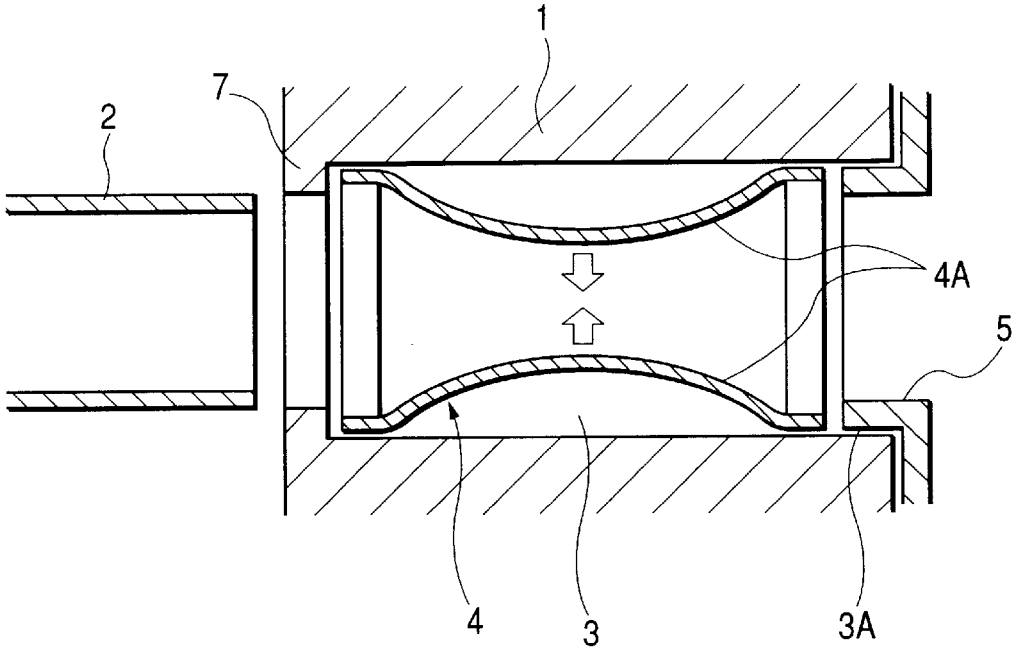
FIG. 7 is a sectional side view of a conventional shield connector.
Figure 7B:
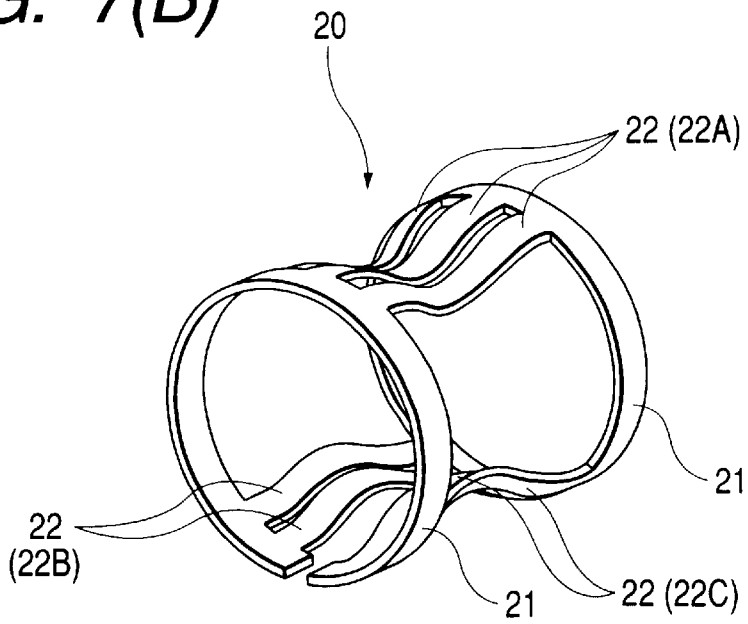

The configuration of the shield connector 10 has been described above. A partner-side connector 50 to be coupled with the shield connector 10 is shown in FIG. 6, in which a not-shown female type terminal metal member is housed within a terminal housing tube 52 provided at a connector housing 51. The terminal housing tube 52 is configured in a manner that the rear end of a tube portion 53 with a small diameter is covered by the front end of a tube portion 54 with a large diameter and these ends are communicated partially by a communicating wall (not shown). A shield shell 55 is inserted and assembled at a space between the both tube portions 53, 54. The shield shell 55 covers the outer peripheral surface of the tube portion 53 with the small diameter of the terminal housing tube 52. A gate-shaped lever 56 is provided at the outer peripheral surface of the connector housing 5*l* so as to be rotatable. Cam grooves (not shown) corresponding to the cam followers 37 are formed at a pair of leg portions 57 (only one of the leg portions 57 is shown in FIG. 6) provided at the lever 56.

The action and effects of the embodiment will be explained.

In the case of coupling the shield connector 10 to the partner-side connector 50, the cam followers 37 of the shield connector 10 are made engage with the cam grooves of the lever 56 provided at the partner-side connector 50, and the lever 56 is rotated. Thus, the both connectors 10, 50 are drawn to each other, whereby the terminal housing tube 52 of the partner-side connector 50 approaches within the terminal housing portion 31. Then, the shield shell 55 covering the outer surface of the tip end side of the terminal housing tube 52 moves into the fit-in portions 15 of the inner housing 12, so that the belt portions 19B of the belt-shaped elastic pieces 19 are applied with a force directed to the inner side of the inner housing fit-in hole 34 due to the sliding-contact resistance between the belt-shaped elastic pieces and the shield shell 55. However, according to the embodiment, since the belt-shaped elastic pieces 19 are engaged at their front ends with the fit-in portions 15, the sliding-contact resistance acts as a force of pulling the belt-shaped elastic pieces 19.

As a result, according to the shield connector 10 of the embodiment, unlike the conventional technique, the belt-shaped elastic pieces 19 are prevented from being compressed and extending inside, so that the fitting operation of the connectors can be performed smoothly.

In the embodiment, the shell coupling metal member recited in the invention as in aspect 1 is configured by a plurality of the belt-shaped elastic pieces 19 with the same shape. Each of the belt-shaped elastic pieces 19 can be formed easily from a metal plate of almost rectangular shape, so that the shell coupling metal member of the invention is quite good in yield of material as compared with the conventional shell coupling metal member. Further, since the conventional shell coupling metal member is formed integrally, the shell coupling metal member is required to be formed in accordance with the outer diameter of the shield shell 55 that is inserted into the shell coupling metal member. In contrast, like the embodiment, when the shell coupling metal member is configured by a plurality of the belt-shaped elastic pieces 19, the shell coupling metal member can be commonly used among various kinds of shield connectors in which shield shells with different outer shapes are inserted.

Further, for example, when the partner-side connector 50 is inserted diagonally with respect to the external housing 11, the belt-shaped elastic pieces 19 may be pressed with an excessive force against the inner side surface of the fit-in portions 15 of the inner housing 12 by the tip end portion of the shield shell 55. In this respect, according to the invention, each of the fit-in portions 15 is provided with the slit portions S for passing the belt-shaped elastic pieces 19 from the inside to the outside of the fit-in portion 15. Thus, the belt-shaped elastic pieces are prevented from being scooped by the inner side surface of the fit-in portion 15 and being bent excessively, and so the elastic configuration of each of the belt-shaped elastic pieces 19 can be protected.

(Other Embodiment)

The invention is not limited to the aforesaid embodiment, and embodiments explained later are contained in the technical scope of the invention and further the invention can be implemented by modifying the embodiment in various ways within a scope of the gist of the invention.

(1) Although in the aforesaid embodiment, the holding portion is formed by the cylindrical fit-in portion 15, the configuration of the holding portion is not limited to the cylindrical shape as long as the holding portion is provided so as to be extended to the opening end side of the external housing and positioned at the outside of the shield shell. For example, the holding portion may be configured in a manner that the cylindrical fit-in portion 15 is divided vertically from the front end thereof to a position near the base end thereof into two pieces thereby to place a pair of holding pieces thus obtained in an opposite state.

(2) Although in the aforesaid embodiment, the shell coupling metal member is configured by the plurality of the belt-shaped elastic pieces 19 of the same shape, the shell coupling metal member may be configured in a manner that one of the two ring portions 21 of the aforesaid conventional shield contact 2 is cut off and the remaining ring portion 21 is engaged with the opening end side of the fit-in portion 15. However, when the shell coupling metal member is configured like the aforesaid embodiment, the yield of the material is good.

What is claimed is:

1. A shield connector, comprising:

an external housing with electric conductivity, and an insulative inner housing holding a terminal metal member to be coupled with a terminal metal member of a partner-side connector accommodated within said external housing, wherein when said partner-side connector is fitted into said shield connector, said terminal metal members of said shield connector and said partner-side connector are coupled to each other, and a shield shell of said partner-side connector is coupled with said external housing, and wherein said inner housing includes:

a holding portion which extends toward an opening end side of said external housing, and is positioned outside of said shield shell of said partner-side connector fitted into said shield connector, a shell coupling metal member which contacts with said shield shell at an inside of said holding portion and contacts with said external housing at an outside of said holding portion, and is engaged at a front end thereof with said holding portion.

2. The shield connector according to claim 1, wherein said shell coupling metal member is configured by a plurality of pieces, and said holding portion is provided with slits for passing said elastic pieces from an inside of said holding portion to an outside thereof.

3. The shield connector according to claim 1, wherein said holding portion is formed to have a cylindrical shape in which said shield shell is inserted.

4. The shield connector according to claim 1, wherein said shell coupling metal member is configured by a plurality of belt-shaped elastic pieces having a same shape.

* * * * *